US008912469B2

(12) United States Patent
Shaw

(10) Patent No.: US 8,912,469 B2
(45) Date of Patent: Dec. 16, 2014

(54) SAFETY DEVICE

(75) Inventor: Gary Owen Shaw, Kinghorn (GB)

(73) Assignee: Jordan Shaw Limited, Glenrothes Fife (GB)

( * ) Notice: Subject to any disclaimer, the term of this patent is extended or adjusted under 35 U.S.C. 154(b) by 1321 days.

(21) Appl. No.: 12/439,306

(22) PCT Filed: Aug. 29, 2007

(86) PCT No.: PCT/GB2007/003249

§ 371 (c)(1),
(2), (4) Date: Jul. 10, 2009

(87) PCT Pub. No.: WO2008/025971

PCT Pub. Date: Mar. 6, 2008

(65) Prior Publication Data

US 2009/0302026 A1 Dec. 10, 2009

(30) Foreign Application Priority Data

Aug. 30, 2006 (GB) ..... 0617014.6

(51) Int. Cl.
*H05B 1/02* (2006.01)
*F24C 7/08* (2006.01)

(52) U.S. Cl.
CPC ..... *F24C 7/08* (2013.01)
USPC ..... 219/493; 219/492; 219/481; 219/489

(58) Field of Classification Search
USPC ..... 219/411–414, 481, 489, 492, 493, 506, 219/519
See application file for complete search history.

(56) References Cited

U.S. PATENT DOCUMENTS

| | | | | |
|---|---|---|---|---|
| 5,717,188 | A | 2/1998 | Vaillancourt | |
| 6,140,620 | A * | 10/2000 | Aldridge et al. | 219/493 |
| 2002/0000436 | A1 * | 1/2002 | Hashimoto et al. | 219/497 |
| 2004/0027248 | A1 | 2/2004 | Lile | |
| 2005/0011881 | A1 * | 1/2005 | Kijimoto et al. | 219/506 |

FOREIGN PATENT DOCUMENTS

| | | |
|---|---|---|
| DE | 101 22 402 | 11/2002 |
| DE | 20 2004 012 586 | 11/2004 |
| GB | 2 267 751 | 12/1993 |
| WO | WO 00/53975 | 9/2000 |
| WO | WO 2007/064962 | 6/2007 |
| WO | WO 2007/139521 | 12/2007 |

OTHER PUBLICATIONS

International Search Report for PCT/GB2007/003249, mailed Apr. 14, 2008.

* cited by examiner

*Primary Examiner* — Brian Jennison
(74) *Attorney, Agent, or Firm* — Nixon & Vanderhye PC

(57) ABSTRACT

A safety device for regulating the supply of electricity and/or fuel to an appliance. Electricity and/or fuel may be supplied to an appliance for a period of time responsive to a user operating a user operable control means, such as a button. The safety device will cut off the supply of electricity and/or fuel after a first period of time unless the user operable control means is operated again to extend the period of time for which the regulator means allows the supply of electricity and/or fuel. Thus, the user must periodically operate the user operable control means if the appliance is to continue functioning. The safety device may function differently at different times of the day. The safety device is particularly useful with electric or fuel burning cookers, to reduce the risk of fire when the cooker is inadvertently left unattended.

25 Claims, 3 Drawing Sheets

SAFETY DEVICE

FIELD OF THE INVENTION

The present invention relates to the field of safety devices for use with electricity and/or fuel powered appliances, for example, cookers.

BACKGROUND TO THE INVENTION

The background to the invention will be illustrated with reference to appliances which are cookers. However, the invention is also applicable to other electricity and/or fuel powered appliances which can be dangerous if they are left unattended.

It is irresponsible to allow cookers to remain unattended while they are in use. Cookers which are left unattended for a period of time can constitute serious safety hazards. For example, an overheated pan containing oil, such as a chip pan, can burn, causing a serious fire which may injure or kill people in the same building, as well as damaging property.

Cookers may be left unattended inadvertently when a user forgets that they have left the cooker on, falls asleep or becomes incapacitated, e.g. due to an accident. It is desirable to provide a safety device which would switch the cooker off if the user did not attend the cooker and thereby promote responsible cooking.

An aim of the invention is to provide a safety device which is useful for reducing the risk resulting from an appliance being left unattended. Another aim of some embodiments of the invention is to provide a safety device which promotes responsible cooking.

The safety device is particularly applicable for use with people who are considered at risk of leaving a cooker unattended, perhaps because they may forget that their cooker is switched on or fall asleep, or because they risk being incapacitated by injury.

SUMMARY OF THE INVENTION

According to a first aspect of the present invention, there is provided a safety device comprising regulator means for regulating the supply of electricity and/or fuel to an appliance, which regulator means by default cuts off the supply of electricity and/or fuel, and user operable control means which, responsive to a first operation of the user operable control means by a user, causes the regulator means to allow the supply of electricity and/or fuel for a first period of time, wherein the user operable control means is adapted to extend the period of time for which the regulator means allows electricity and/or fuel to be supplied responsive to the user operating the user operable control means again, subsequently to the said first operation by a user.

Thus, the user must operate the user operable control means again, after the said first operation by a user, in order for the appliance to function after the first period of time has elapsed. If the user falls asleep or is incapacitated or forgets to operate the user operable control means again, the regulator will cut off the supply of electricity and/or fuel after the first period of time, which for typical appliances would stop them functioning. This reduces this risk of a fire resulting from the user falling asleep, being incapacitated or forgetting about the appliance. This is particularly relevant where the appliance is a cooker in which case the device promotes responsible cooking. Once the period of time for which the regulator means allow electricity and/or fuel to be supplied has elapsed and the regulator has again cut off the supply of electricity and/or fuel, the device can be used again by the user again making another first operation of the user operable control means.

Preferably, the first period of time is a predetermined period of time, for example, it may be a set period of time (e.g. 5, 10 or 15 minutes). However, the first period of time may be selectable by a user operating the user operable control means, up to a predetermined maximum period of time. For example, the user operable control means may include means to input a period of time, for example a dial or buttons. The first period of time may depend on the number of times that the user operates the user operable control means. For example, the first period of time may be incremented by a set period of time whenever the user operable control means is operated, up to a predetermined maximum period of time.

The user operable control means may respond to subsequent operation of the user operable control means by extending the period of time for which the regulator means allows electricity and/or fuel to be supplied by a predetermined period of time. The period of time for which the regulator means allows electricity and/or fuel to be supplied may be extended until a predetermined period of time from the subsequent operation of the user operable control means. Optionally, this predetermined period of time from the subsequent operation of the user operable control means is the same as the first period of time. For example, if the first period of time is, say, twenty minutes, subsequent operation of the user operable control means may cause the period of time for which the regulator means allows electricity and/or fuel to be supplied to be extended until twenty minutes from the subsequent operation of the user operable control means.

Preferably, the period of time for which the regulator means allows electricity and/or fuel to be supplied may only be extended by subsequent operation of the user operable control means a predetermined number of times before the regulator means again cuts off the supply of electricity and/or fuel.

Preferably, the period of time for which the regulator means allows electricity and/or fuel to be supplied may only be extended in response to the subsequent operation of the user operable control means once at least a second period of time has elapsed after the first operation by the user.

The second period of time is typically a predetermined period of time. Where the first period of time is a predetermined period of time, the second period of time may be the same period of time.

The second period of time may be less than the first period of time. Thus, the control means may be operable to extend the period of time for which electricity and/or fuel is supplied to an appliance responsive to operation by the user of the user operable control means after the second period of time. The second period of time may finish a set period of time before the end of the first period of time.

Preferably, the response of the user operable control means to operation by the user depends on the time of day. A time signal may be received through an input or the safety device may comprise a clock. More preferably, the first and/or second periods of time depend on the time of day. Preferably, the regulator means allows electricity and/or fuel to be supplied, responsive to operation by a user of the user operable control means, only at certain times of the day. Thus, the safety device may not allow an appliance to function at times when the user is at risk of falling asleep, e.g. during the night.

The user operable control means preferably requires physical contact by a user to be operated. For example, the user operable control means may comprise a touch sensitive button or a push button. Typically, the same touch sensitive button, push button or other manually operable device is operable both to cause the regulator to start allowing the supply of electricity and/or fuel and to extend the period of time. However, the user operable control means may comprise two or more touch sensitive buttons, push buttons or other manually operable devices, one of which is operable to cause the regulator to start allowing the supply of electricity and/or fuel and another of which is operable to extend the period of time.

Preferably, a part of the user operable control means must be moved to operate the user operable control means and the user operable control means responds to that movement. For example, the user operable control means may comprise a resiliently biased button and the user operable control means may respond to one of the button being pushed in or the button being released. This prevents a user from causing the user operable control means to be operated while they are not present by taping or wedging the button in place.

The user operable control means may comprise a remote control device.

The user operable control means typically comprises a microprocessor.

Preferably, the safety device further comprises tamper-resistant control means which are operable to set control parameters which affect the functionality of the safety device. The control parameters which can be set using the tamper-resistant control means may include one or more of a predetermined value of the first period of time, a maximum value of the period of time for which the regulator means allows the supply of electricity and/or fuel, the second period of time, the time stored by a clock (where present), and times of the day when the user operable control means does not cause the regulator means to allow electricity and/or fuel to be supplied to an appliance.

The tamper-resistant control means may comprise a password or PIN number protected data input means (such as a key pad) to enable control parameters to be set, a lock which requires a key to enable control parameters to be set, or an electronic lock or electronic interface which requires an electronic device such as a smart card, electronic key, RFID tag, or an input device which plugs into the interface to enable control parameters to be set. In a preferred embodiment, the tamper-resistant control means comprises a lock which receives a key with an integrated RFID tag, and the tamper resistant control means further comprises an RFID tag reader, wherein the tamper-resistant control means requires the key to be operated and the RFID tag to be present before control parameters may be set.

The safety device may comprise a plurality of pre-stored sets of control parameters and the tamper-resistant control means may enable an authorised party to change the control parameters to one of the pre-stored sets of control parameters.

The safety device may comprise an indicator which indicates when the user operable control means has been operated by a user and the regulator means is allowing electricity and/or fuel to be supplied. The indicator may indicate when the period of time for which the regulator means allows the supply of electricity and/or fuel is close to expiring. For example, the visual indicator may be a light source, such as an LED, which is lit when the regulator means is allowing electricity and/or fuel to be supplied and which flashes a predetermined period of time before the end of the period of time for which the regulator means allows the supply of electricity and/or fuel. The safety device may comprise a visual indicator which indicates how much time remains before the regulator means will cut off the supply of electricity and/or fuel.

The safety device may comprise an audible indicator which indicates when the period of time for which the regulator means allows the supply of electricity and/or fuel has expired. The safety device may comprise an audible indicator which indicates when the period of time for which the regulator means allows the supply of electricity and/or fuel is close to expiring. For example, the safety device may comprise a sounding device, such as a loudspeaker, which emits a beeping or buzzing sound, when the period of time for which the regulator means allows the supply of electricity and/or fuel expires, and/or for a predetermined period of time before the end of the period of time for which the regulator means allows the supply of electricity and/or fuel.

The safety device may further comprise a gas sensor for sensing toxic and/or dangerous gas, and/or a smoke sensor. A carbon monoxide sensor may be used to detect carbon monoxide levels in a room. A combustible gas sensor could be used to detect whether there is a gas leak or a gas cooker has been left on but without gas being combusted. A smoke sensor may be used to detect burning.

The safety device may comprise a plurality of gas and/or smoke sensors. The or each gas and/or smoke sensor may be incorporated within the housing of the safety device. However, the or each gas and/or smoke sensor is preferably attached to the housing of the safety device by a flexible connecter. This allows the or each gas and/or smoke sensor to be located at a different location to the housing of the safety device. Wires for communicating with the or each gas and/or smoke sensor may pass through the flexible connecter. Where there are a plurality of gas and/or smoke sensors, one or more may be incorporated into the housing of the safety device and one or more may be attached to the housing of the safety device by a flexible connecter.

The safety device monitors the gas concentrations measured by the or each gas and/or smoke sensor. If the concentration of gas (and/or smoke as appropriate) which is measured exceeds a predetermined threshold, the safety device indicates that the concentration of gas (and/or smoke as appropriate) exceeds the predetermined threshold and cuts off the supply of electricity and/or fuel. The safety device typically indicates that the concentration of gas (and/or smoke as appropriate) has exceed the predetermined threshold by emitting a sound using a sounding device, such as a loudspeaker. The sound emitted by the sounding device when the concentration of gas (and/or smoke as appropriate) exceeds a predetermined threshold is preferably different to the sound emitted by the sounding device when the period of time for which the regulator means allows the supply of electricity and/or fuel expires, and/or during a predetermined period of time before the end of the period of time for which the regulator means allows the supply of electricity and/or fuel.

The regulator means may regulate the supply of electricity. The regulator means may regulate the supply of fuel, such as gas or oil. The regulator means may regulate the supply of both electricity and fuel, for example, when the safety device is for use with a gas or oil cooker which also requires an electricity supply.

Where the regulator means regulates the supply of electricity, the regulator means may comprise an isolator, such as a relay, for connecting and disconnecting the electricity supply to an appliance. The relay will typically be a normally-open relay. Where the regulator means regulates the supply of fuel, the regulator means may comprise a solenoid switch for operating a valve which connects and disconnects the fuel supply to an appliance.

The safety device may comprise a battery. The safety device may comprise a connection for receiving an external power supply. The battery may function as a back-up in case the external power supply fails. The safety device is preferably such that the regulator means cuts out the supply of electricity and/or fuel to an appliance in the event that there is a power failure in the safety device (perhaps because a battery has run out or the external power supply has failed).

The safety device may be adapted for connection to the electricity and/or fuel supply of an appliance such that the regulator means regulates the supply of electricity and/or fuel to the appliance before the electricity and/or fuel supply reaches the appliance. For example, the regulator means may comprise an electricity input and output and/or a fuel inlet and a fuel outlet.

The safety device may be wall mountable and may comprise fixing means, such as screw holes, for use in mounting the safety device on a wall.

The invention also extends in a second aspect to an appliance comprising a safety device according to the first aspect of the invention, wherein the regulator means regulates the supply of electricity and/or fuel to a functional part of the appliance. The functional part of the appliance may comprise heating means. For example, the appliance may be an electric cooker and the functional part of the appliance may comprise a heating element (e.g. a hob and/or electric oven). The appliance may be a fuel burning cooker, such as an oil or gas cooker, and the functional part of the appliance may comprise a fuel burner (e.g. an oil or gas hob and/or an oil or gas oven). The appliance may be a combined electric and fuel burning cooker and the functional part of the appliance may comprise both a heating element and a fuel burner. The regulator means of the safety device may be a regulator means of the appliance. The user operable control means of the safety device, or a part thereof (e.g. the microprocessor, where present) may be, or may be part of, a control means of the appliance (e.g. a microprocessor which controls the appliance). The safety device may be adapted to be suitable for mounting in a hole in a control panel of the appliance, such that a part of the user operable control means which requires physical contact by a user to be operated (e.g. a button) and/or a visual indicator are thereby located on the control panel where they can be operated and/or seen respectively by a user. The safety device may be retrofitted to the appliance.

The invention also extends in a third aspect to a building comprising a room, wherein the room comprises a cooker and a safety device according to the first aspect of the invention, and wherein the supply of electricity and/or fuel to the cooker is regulated by the regulator means of the safety device.

Preferably, the building comprises a plurality of said rooms, wherein the response of the safety devices in two of more of the said rooms to operation by a user of the respective user operable control means is different, at least at some times of the day, in two or more of said rooms. For example, at some times of the day, the user operable control means of the safety device in a first said room may cause the regulator means of the respective safety device to allow electricity and/or fuel to be supplied to an appliance in response to user operation of the user operable control means, but the user operable control means of the safety device in a second said room may not be operable to cause the regulator means of the respective safety device to allow electricity and/or fuel to be supplied to an appliance in response to user operation of the user operable control means.

DESCRIPTION OF THE DRAWINGS

An example embodiment of the present invention will now be illustrated with reference to the following Figures in which.

DETAILED DESCRIPTION OF AN EXAMPLE EMBODIMENT

Example One

Figure 1:
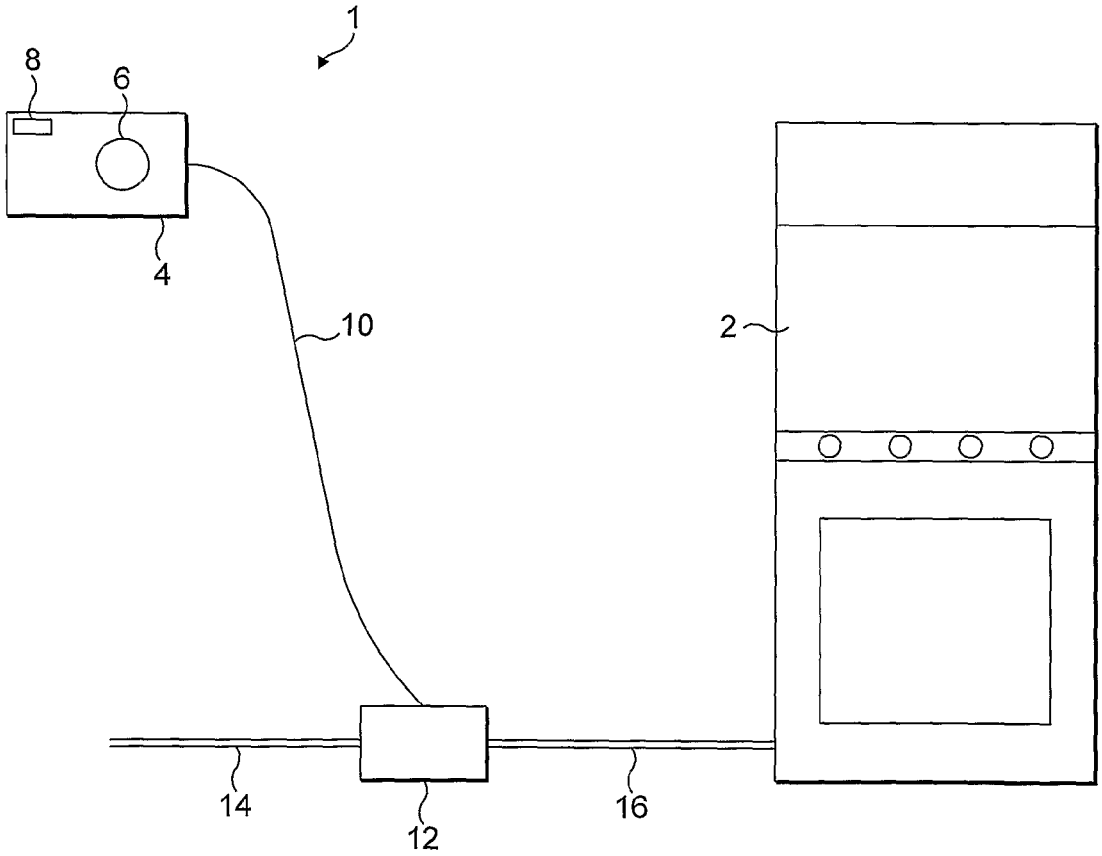
FIG. 1 is a front elevation of a first example of a safety device according to the present invention which is attached to and used to regulate the supply of gas to a gas cooker.

FIG. 1 is a front elevation of a first example of a safety device 1 according to the present invention which is attached to and used to regulate the supply of gas to an appliance which, in this example, is a gas cooker 2. The safety device is mounted in the same room as the cooker. Usually, the safety device will be adjacent to the cooker.

The safety device comprises a housing 4 on which is mounted a button 6 which functions as part of user operable control means. The button will typically be reasonably large so that it is easy to operate. The housing includes an indicator in the form of an LED 8. A cable 10 extends from the housing to an electronically operated valve 12 which functions as regulator means. In FIG. 1, the electronically operated valve has an inlet pipe 14 which is attached to mains gas and an outlet pipe 16 which connects the valve to the gas inlet of the gas cooker. The valve regulates the flow of gas between the inlet and outlet pipes and thus regulates the supply of gas to the cooker.

Figure 2:
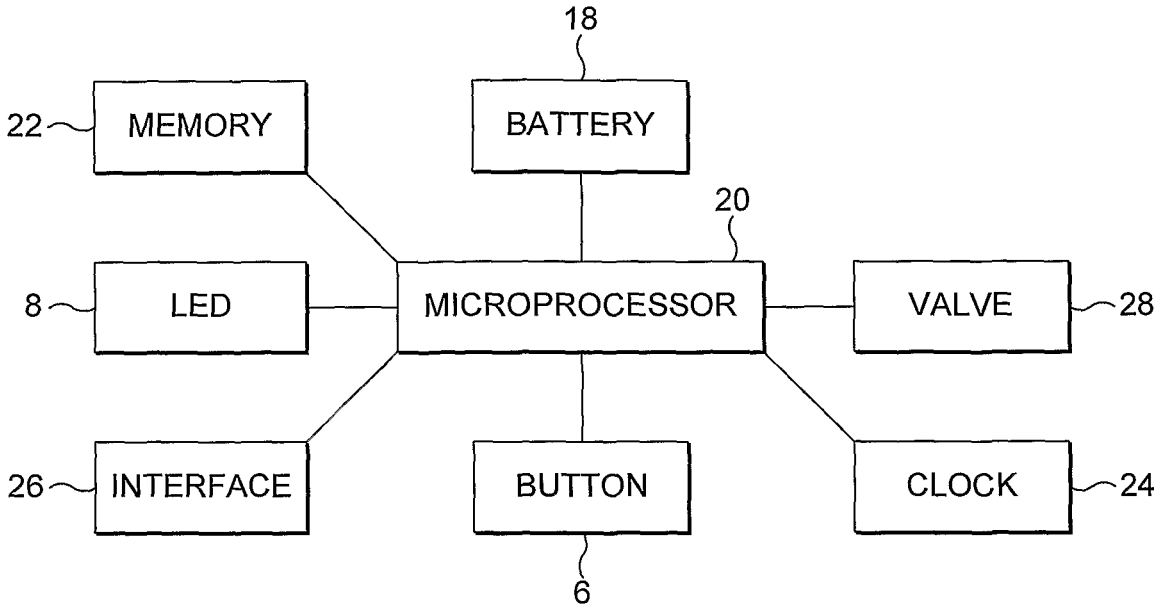
FIG. 2 is a schematic diagram of key components 2 of the safety device.

FIG. 2 is a schematic diagram of key components of the safety device. The housing contains a battery 18 which powers a microprocessor 20 which functions as part of the user operable control means. The microprocessor is in electronic communication with a memory 22 for storing control parameters etc. A clock circuit 24 (such as a quartz crystal oscillator) provides regular time pulses enabling the microprocessor to keep track of time.

The microprocessor is also in electronic communication with the button, LED and electronically activated valve, as well as an electronic interface 26 which is operable to receive instructions from a programming device (not shown) which can be brought into electronic communication with the electronic interface to program the safety device. The electronic interface is located within the housing such that the housing must be opened, e.g. by unscrewing, in order for the electronic interface to be accessed. As the safety device can only be programmed with the appropriate programming device, the electronic interface functions as tamper-resistant control means.

The electronically activated valve is typically operated by a solenoid under the control of the microprocessor.

Normally, the electronically activated valve is closed, gas is not supplied to the cooker and the LED is not illuminated. In use, the user presses the button a first time, in response to which the valve is opened, allowing gas to flow from the gas supply, through the electronically activated valve, out of the outlet of the electronically activated valve, to the gas inlet of the cooker. Once the button is pressed, the valve will remain open for a predetermined first period of time, for example, twenty minutes, and so the cooker will function for the first period of time. When the button is pressed, the LED is illuminated to indicate that gas is being supplied to the cooker.

Towards the end of the period of time, for example two minutes before the end of the period of time, the LED starts flashing under the control of the microprocessor. If the user does not press the button again, the electronically activated valve cuts off the supply of gas to the gas cooker, stopping the cooker from functioning. The LED switches off, the safety device returns to its initial state and the user must press the button again in order to allow the cooker to function once again.

If, however, the user presses the button again during period of time when the LED is flashing, the valve will remain open for a further period of time, for example for the same time as the predetermined first period of time, from when the button is pressed. As before, the LED is initially illuminated continuously and then starts to flash towards the end of this extended period of time and the supply of gas will be cut off after the extended period of time unless the button is again pressed towards the end of the this period of time.

If the user presses the button again before the LED has started flashing, this does not extend the period of time for which fuel is supplied to the cooker. This means that in order for fuel to be supplied to the cooker for more than twenty minutes, the user has to operate the button at least a second period of time (in this case, eighteen minutes) after the button was first pressed. Thus the user must continue to return to the safety device periodically in order for the cooker to continue to function. If the user falls asleep, forgets that the cooker is switched on, or is incapacitated due to an accident, the cooker will switch off.

Example Two

In a second example, the period of time for which the valve remains open can be extended at any time after the button was first pressed to cause the device to allow the supply of gas to the cooker. For example, if the button is subsequently pressed, the period of time for which the valve remains open may be extended until a set period of time, such as twenty minutes, from when the button was subsequently pressed.

However, in this example, the period of time for which the valve remains open can only be extended a set number of times, for example once, before the supply of gas is cut off.

In one embodiment, the valve remains open for a period of time, such as twenty minutes, in response to the button being pressed for a first time. When the button is pressed for a second time, the valve will remain open for a period of time, such as twenty minutes, from this subsequent pressing of the button. However, the time for which the valve remains open can only be extended a predetermined number of times, such as once, before the valve must be closed and remain closed for a period of time.

Example Three

Figure 3:
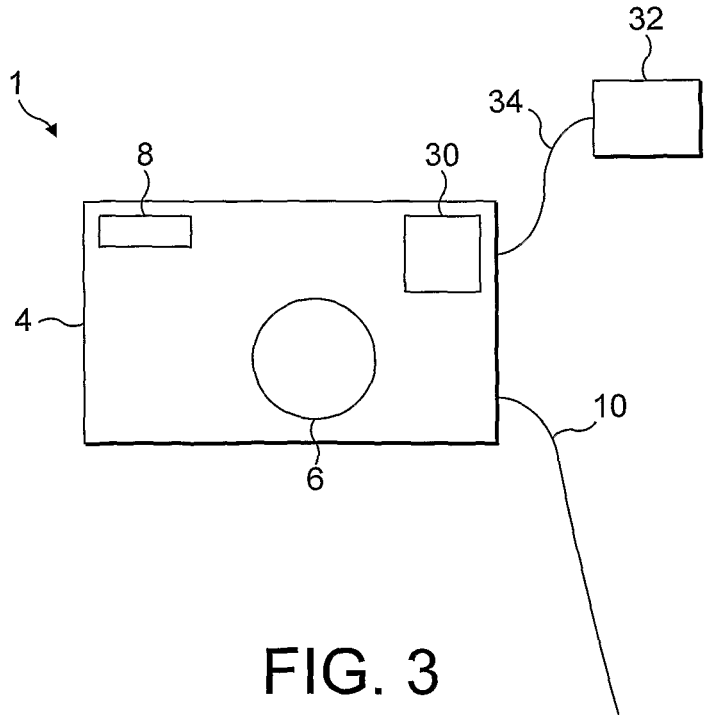
FIG. 3 is a schematic diagram of a third example safety device.

FIG. 3 is a schematic diagram showing a third example safety device. A safety device 1 according to either of the first or second examples, further comprises a built in carbon monoxide sensor 30, which is integrated into the housing of the safety device and an external smoke sensor 32 which is attached to the housing of the safety device through a flexible connector 34 which includes the wires required for the safety device to power the smoke sensor and receive signal from it. The smoke sensor is located close to a cooker where cooker food may burn if the cooker is left unattended.

In use, the carbon monoxide sensor generates a signal which is related to the carbon monoxide concentration. The smoke sensor generates a signal which is related to the smoke concentration. If the signal generated by the carbon monoxide sensor indicates that the carbon monoxide concentration exceeds a predetermined safe concentration, or if the signal generated by the smoke sensor indicates that the smoke concentration exceeds a predetermined normal concentration, the safety device makes a beeping sound using a loudspeaker, and closes the valve, cutting off the supply of fuel to the cooker.

Further Examples and Variations

The button may be configured such that the safety device responds either to the button being pressed in or the button being released. Thus, it will generally not be possible to extend the period of time for which the valve remains open by taping down the button or jamming the button.

In some embodiments of the invention, the safety device will not function at all, or will function differently, at different times of the day. For example, the safety device may switch off the supply of gas to the cooker at times which are considered to be of particular risk, say between midnight and 6 am, during which time it will not respond to the user pressing the button by allowing the supply of electricity and/or gas to an appliance.

Figure 4:
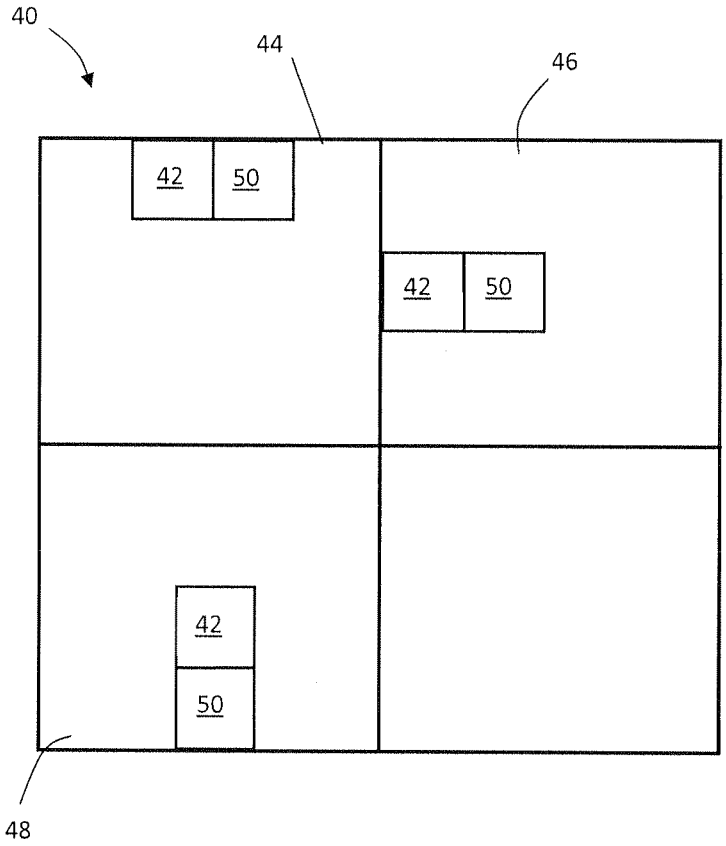
FIG. 4 is a plan view of a building with safety devices installed on appliances within rooms of the building.

The safety device is therefore useful within a building 40 (see FIG. 4) such as a hospital or care home where different users may have different lifestyle patterns (e.g. whether they work during the day or the night) or be considered to be at different levels of risk of an accident occurring. In this case, cookers 42 in different rooms 44, 46, 48 may each have a safety device 50 fitted thereto, and two or more of the safety device in the building may be set to operate at different times, or with different first and second periods of time.

The safety device is therefore useful within a building such as a hospital or care home where different users may have different lifestyle patterns (e.g. whether they work during the day or the night) or be considered to be at different levels of risk of an accident occurring. In this case, cookers in different rooms may each have a safety device fitted thereto, and two or more of the safety devices in the building may be set to operate at different times, or with different first and second periods of time.

In a further example embodiment, the cooker is an electric cooker and the electronically operated valve is replaced with a relay or other electronically activated switch. The relay or other electronically activated switch receives inputs power from the electric main through a power input and regulates the supply of electricity out through a power outlet to an electricity inlet of the electric cooker. The relay or other electronically activated switch is switched on, in order to allow the supply of power to the electricity inlet of the electric cooker, or switched off, to cut off the supply of power to the electricity inlet of the electricity cooker in a manner corresponding to the opening or closing of the valve in the first and second examples.

One skilled in the art will appreciate that a number of variations in the functionality of the safety device are possible within the scope of the invention. For example, the safety device may be operable to allow the supply of gas and/or electricity for a period of time (e.g. five minutes) when the button is pressed, and this period may be extended for a further period of time (e.g. a further five minutes) each time the button is pressed, up to a predetermined maximum period of time (e.g. twenty minutes) to set the first period of time. In this embodiment, the period of time for which electricity and/or gas is supplied to the appliance cannot be extended by pressing the button until a second period of time (e.g. five minutes) have passed, whereupon the period of time for which electricity and/or gas is supplied is extended (e.g. for five minutes) but again up to a maximum period of time (e.g. twenty minutes).

Typically, the safety device will be designed in a fail safe fashion, such that when the electricity supply to the safety device fails (e.g. because the battery runs out), the regulator means will cut off the supply of electricity and/or gas to the appliance. Thus, an electronically activated valve will typically be a normally closed valve and an electronically activated switch will typically be a normally off switch, such as a normally open relay.

Further modifications and variations may be made within the scope of the invention herein disclosed.

The invention claimed is:

1. A safety device comprising regulator means for regulating the supply of electricity and/or fuel to an appliance, which regulator means by default cuts off the supply of electricity and/or fuel, and user operable control means which, responsive to a first operation of the user operable control means by a user, causes the regulator means to allow the supply of electricity and/or fuel for a predetermined first period of time, wherein the user operable control means is configured to extend the predetermined first period of time for which the regulator means allows electricity and/or fuel to be supplied responsive to the user operating the user operable control means again, wherein the response of the user operable control means to operation by the user also depends on the time of day such that the predetermined first period of time varies depending upon the time of day that the user operable control means is operated.

2. A safety device according to claim 1, wherein the predetermined first period of time is selectable by a user operating the user operable control means, up to a predetermined maximum period of time.

3. A safety device according to claim 1, wherein the predetermined period of time for which the regulator means allows electricity and/or fuel to be supplied may only be extended by subsequent operation of the user operable control means a predetermined number of times before the regulator means again cuts off the supply of electricity and/or fuel.

4. A safety device according to claim 1, wherein the period of time for which the regulator means allows electricity and/or fuel to be supplied may only be extended in response to the subsequent operation of the user operable control means once at least a second period of time has elapsed after the first operation by the user.

5. A safety device according claim 4, wherein the second period of time is the same as the first period of time.

6. A safety device according to claim 4, wherein the second period of time finishes a predetermined period of time before the end of the predetermined first period of time.

7. A safety device according to claim 1, wherein the regulator means allows electricity and/or fuel to be supplied responsive to operation by a user of the user operable control means only at certain times of the day.

8. A safety device according to claim 1, wherein the user operable control means requires physical contact by a user to be operated.

9. A safety device according to claim 1, further comprising tamper-resistant control means which are operable to set control parameters which affect the functionality of the safety device.

10. A safety device according to claim 9, wherein the control parameters which can be set using the tamper-resistant control means include one or more of a predetermined value of the first period of time, a maximum value of the first period of time, a second period of time, the time stored by a clock, and times of the day when the user operable control means does not cause the regulator means to allow electricity and/or fuel to be supplied.

11. A safety device according to claim 1, wherein the safety device comprises a visual indicator which indicates when the regulator means is allowing electricity and/or fuel to be supplied.

12. A safety device according to claim 11, wherein the safety device comprises a visual indicator which indicates when the period of time for which the regulator means allows the supply of electricity and/or fuel is close to expiring.

13. A safety device according to claim 1, wherein the safety device comprises an audible indicator which indicates when the period of time for which the regulator means allows the supply of electricity and/or fuel has expired.

14. A safety device according to claim 1, wherein the safety device comprises an audible indicator which indicates when the period of time for which the regulator means allows the supply of electricity and/or fuel is close to expiring.

15. A safety device according to claim 1, wherein the safety device comprises a gas sensor for sensing toxic and/or dangerous gas, and/or a smoke sensor, and wherein the safety device is operable to cause the regulator means to cut off the supply of electricity and/or fuel when the gas sensor senses a concentration of toxic and/or dangerous gas which exceeds a predetermined concentration, or when the smoke sensor senses a concentration of smoke which exceeds a predetermined concentration.

16. A safety device according to claim 15, wherein the safety device comprises a housing, and a gas sensor or a smoke sensor is connected to the housing of the safety device by a flexible connector.

17. A safety device according to claim 1 when the regulator means regulates the supply of electricity, the regulator means comprises an isolator for connecting and disconnecting the electricity supply to an appliance.

18. A safety device according to claim 1 when the regulator means regulates the supply of fuel, the regulator means comprises an electronically operated valve for connecting and disconnecting the fuel supply to an appliance.

19. An appliance comprising a safety device according to claim 1, wherein the regulator means regulates the supply of electricity and/or fuel to a functional part of the appliance.

20. An appliance according to claim 19, wherein the appliance is a cooker and the functional part of the appliance comprises heating means.

21. A building comprising a room, wherein the room comprises a cooker and a safety device according to claim 1, wherein the supply of electricity and/or fuel to the cooker is regulated by the regulator means of the safety device.

22. A building according to claim 21, comprising a plurality of said rooms, wherein the response of the safety devices in two of more of the said rooms to operation by a user of the respective user operable control means is different, at least at some times of the day, in two or more of said rooms.

23. A safety device comprising:

a regulator configured to regulate the supply of electricity to an appliance, and configured to, by default, cut off the supply of electricity; and a user operable controller configured to:

cause, responsive to a first operation of the user operable controller by a user, the regulator to allow the supply of electricity for a predetermined first period of time, keep track of the time of day, extend the period of time for which the regulator allows electricity to be supplied responsive to the user operating the user operable controller again, subsequently to the first operation by the user, and respond to operation by the user depending on the time of day such that the predetermined first period of time varies depending upon the time of day that the user operable control controller is operated.

24. A safety device comprising:

a regulator configured to regulate the supply of fuel to an appliance, and configured to, by default, cut off the supply of fuel; and a user operable controller configured to:

cause, responsive to a first operation of the user operable controller by a user, the regulator to allow the supply of fuel for a first predetermined period of time, keep track of the time of day, extend the period of time for which the regulator allows fuel to be supplied responsive to the user operating the user operable controller again, subsequently to the first operation by the user, and respond to operation by the user depending on the time of day such that the predetermined first period of time varies depending upon the time of day that the user operable controller is operated.

25. A safety device comprising regulator means for regulating the supply of electricity and/or fuel to an appliance, which regulator means by default cuts off the supply of electricity and/or fuel, and user operable control means which, responsive to a first operation of the user operable control means by a user, causes the regulator means to allow the supply of electricity and/or fuel for a first period of time, wherein the user operable control means is configured to extend the period of time for which the regulator means allows electricity and/or fuel to be supplied responsive to the user operating the user operable control means again, wherein the regulator means allows electricity and/or fuel to be supplied responsive to operation by a user of the user operable control means only at certain times of the day.

* * * * *